US006185749B1

(12) United States Patent
Williams

(10) Patent No.: US 6,185,749 B1
(45) Date of Patent: Feb. 13, 2001

(54) MATCHING HAT AND SCARF

(76) Inventor: George Williams, 1108 Baring St., Camden, NJ (US) 08103

( * ) Notice: Under 35 U.S.C. 154(b), the term of this patent shall be extended for 0 days.

(21) Appl. No.: 09/407,403

(22) Filed: Sep. 28, 1999

Related U.S. Application Data

(60) Provisional application No. 60/102,048, filed on Sep. 28, 1998.

(51) Int. Cl.[7] ..... A42B 1/24

(52) U.S. Cl. ..... 2/209.13; 2/207; 2/195.8; 2/171

(58) Field of Search ..... 2/171, 207, 209.13, 2/175.6, 195.8, 916, 918, 206

(56) References Cited

U.S. PATENT DOCUMENTS

| | | | | |
|---|---|---|---|---|
| D. 359,384 | * | 6/1995 | Dlugokeski | D2/880 |
| D. 365,917 | * | 1/1996 | Armstrong | D2/881 |
| 1,720,560 | * | 7/1929 | Lipper | 2/195.8 |
| 2,420,378 | * | 5/1947 | Lehman et al. | 2/195.8 |
| 2,678,449 | * | 5/1954 | Turscak et al. | 2/20 |
| 5,675,841 | * | 10/1997 | Jackson | 2/175.7 |
| 5,822,800 | * | 10/1998 | Anderson | 2/202 |

* cited by examiner

*Primary Examiner*—John J. Calvert
*Assistant Examiner*—Katherine Moran
(74) *Attorney, Agent, or Firm*—Goldstein & Canino

(57) ABSTRACT

A hat and scarf that is made from coordinating material. A band extends around the circumference of the bottom of the hat and secures it to one's head. A loop is secured to the top of the hat. Each end of the loop is stitched to the hat top, thereby creating a small opening between the hat and the loop. At the rear of the hat, a band is secured at both ends by means of a fastener. The fastener is preferably a button or snap, thereby allowing the band to be easily attached or detached from the hat. A strand of coordinating material extends along the rear of the hat. It is fitted through the loop at the hat top and is secured under the band, consequently leaving two ends of the strand dangling from the bottom of the hat. The scarf is made from a flexible material that drapes loosely over one's neck. It is made from the same material as the hat, thereby creating a matching set.

5 Claims, 1 Drawing Sheet

MATCHING HAT AND SCARF

CROSS REFERENCES AND RELATED SUBJECT MATTER

This application is based on subject matter contained in provisional patent application Ser. No. 60/102,048, filed in the United States Patent Office on Sep. 28, 1998.

BACKGROUND OF THE INVENTION

The invention relates to a head gear. More particularly, the invention relates to a hat, to be worn on one's head, and a matching scarf, to be draped around one's neck.

During the cooler months of the year, it is common to wear hats and scarves to protect one's head and neck from the cold weather. Since these articles are often necessary, it should be possible to coordinate the hat and scarf with one's other clothing, thereby creating fashion accessories.

U.S. Pat. No. 58,944 to Rosenberg discloses a unique design for a combined head and neck covering.

U.S. Pat. No. Des. 108,757 to Tannenbaum discloses a unique design for a combined cap and muffler.

U.S. Pat. No. 5,621,920 to Gorsuch et al. discloses a stocking cap with a tail that may be wrapped around one's neck. The end of the tail may then be attached to the cap in order to create either a scarf or a ski mask.

U.S. Pat. No. 2,735,283 to Schuessler discloses a knitted cap structure.

While these units may be suitable for the particular purpose employed, or for general use, they would not be as suitable for the purposes of the present invention as disclosed hereafter.

SUMMARY OF THE INVENTION

It is an object of the invention to produce a matching hat and scarf.

It is a still further object of the invention to produce a matching hat and scarf wherein the hat may be attached to the scarf in order to prevent the loss of either piece.

It is a still further object of the invention to produce a matching hat and scarf that can be coordinated with one's other clothing.

The invention is a hat and scarf that is made from coordinating material. A band extends around the circumference of the bottom of the hat and secures it to one's head. A loop is secured to the top of the hat. Each end of the loop is stitched to the hat top, thereby creating a small opening between the hat and the loop. At the rear of the hat, a band is secured at both ends by means of a fastener. The fastener is preferably a button or snap, thereby allowing the band to be easily attached or detached from the hat. A strand of coordinating material extends along the rear of the hat. It is fitted through the loop at the hat top and is secured under the band, consequently leaving two ends of the strand dangling from the bottom of the hat. The scarf is made from a flexible material that drapes loosely over one's neck. It is made from the same material as the hat, thereby creating a matching set.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
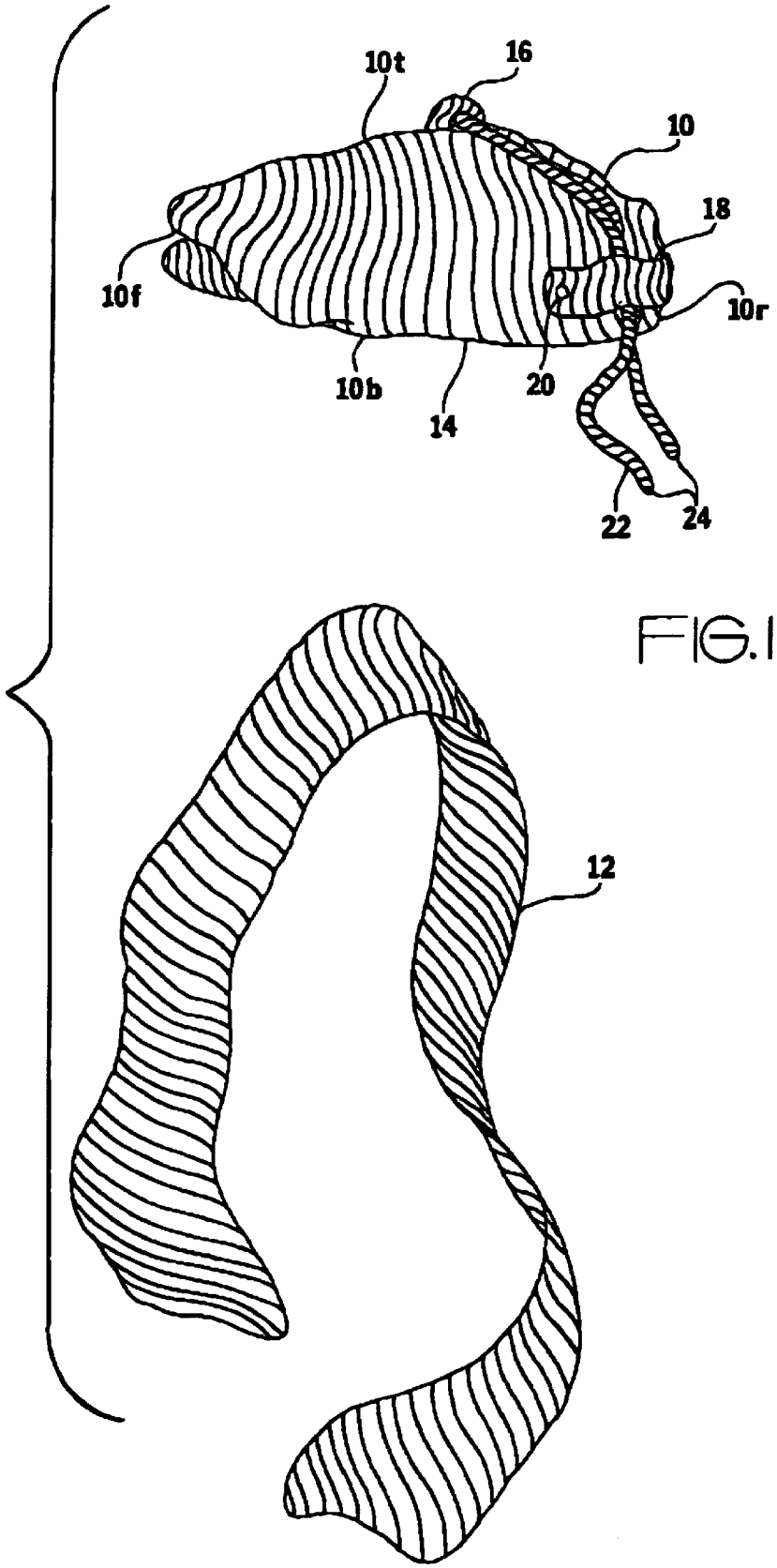
FIG. 1 is a perspective view of the matching hat and scarf.

As required, detailed embodiments of the present invention are disclosed herein; however, it is to be understood that the disclosed embodiments are merely exemplary of the invention, which may be embodied in various forms; therefore, specific structural and functional details disclosed herein are not to be interpreted as limiting, but merely as a basis for the claims and as a representative basis for the claims and as a representative basis for teaching one skilled in the art to variously employ the present invention in virtually any appropriately detailed structure.

FIG. 1 illustrates a hat 10 and scarf 12 that is made from coordinating material. In other words, the hat 10 and scarf 12 are both made from a material having a specific pattern and coloring.

The hat 10 has a top portion 10T, a bottom portion 10B, a rear 10R and a front 10F. A bottom band 14 extends around the circumference of the bottom 10B of the hat 10 and secures said hat 10 to one's head. A loop 16 is secured to the top 10T of the hat 10. Each end of the loop 16 is stitched to the hat top 10T, thereby creating a small opening between the hat 10 and the loop 16.

At the rear 10R of the hat 10, a rear band 18 is secured at both ends to said hat 10 by means of a fastener 20. The fastener 20 is preferably a button or snap, thereby allowing the rear band 18 to be easily attached or detached from the hat 10, according to individual preference.

A strand 22 of coordinating material extends along the rear 10R of the hat 10. It is fitted through the loop 16 at the hat top 10T and is secured under the band 18, consequently leaving two ends 24 of the strand dangling from the bottom 10B of the hat 10.

The scarf 12 is made from a flexible material that drapes loosely over one's neck. It is made from the same material as the hat 10, thereby creating a matching set.

What is claimed is:

1. A garment comprising:

a hat made of a fabric having a pattern and a coloring, the hat further having a front, a rear, a top portion, a bottom portion, and a rear band having two ends, wherein said rear band is attached to the rear of the hat at both ends with a fastener selected from the group consisting of a button and a snap;

a scarf made of a fabric having the same pattern and coloring as said hat.

2. The garment as recited in claim 1, further comprising a strand extending from the hat having a pattern and coloring which is coordinated with the hat.

3. The garment as recited in claim 2, wherein the strand extends from the top portion of the hat, and extends rearward through the rear band.

4. The garment as recited in claim 3, further comprising a loop at the top portion of the hat, wherein the strand is mounted at the top portion of the hat by extending through the loop.

5. The garment as recited in claim 4, wherein the strand has two ends, and wherein the strand is fastened in the loop midway between the two ends, such that the two ends of the strand extend downward along the rear of the hat, through the rear band, and dangle therebelow.

* * * * *